US005088575A

United States Patent [19]

Eriksson

[11] Patent Number: 5,088,575

[45] Date of Patent: Feb. 18, 1992

[54] ACOUSTIC SYSTEM WITH TRANSDUCER AND VENTURI

[75] Inventor: Larry J. Eriksson, Madison, Wis.

[73] Assignee: Nelson Industries, Inc., Stoughton, Wis.

[21] Appl. No.: 582,514

[22] Filed: Sep. 13, 1990

[51] Int. Cl.[5] ..... F01N 1/06

[52] U.S. Cl. ..... 181/206; 381/71

[58] Field of Search ..... 181/206, 209, 252, 255; 381/71

[56] References Cited

U.S. PATENT DOCUMENTS

| | | | |
|---|---|---|---|
| 1,217,021 | 2/1917 | Lebedeff | 381/71 |
| 2,043,416 | 3/1934 | Lueg | 381/71 |
| 4,473,906 | 9/1984 | Warnaka | 381/71 |
| 4,487,289 | 12/1984 | Kicinski et al. | 181/252 |
| 4,665,549 | 5/1987 | Eriksson et al. | 381/71 |
| 4,677,676 | 6/1987 | Eriksson et al. | 381/71 |
| 4,677,677 | 6/1987 | Eriksson et al. | 381/71 |
| 4,697,668 | 10/1987 | Barker | 181/255 X |
| 4,736,431 | 4/1988 | Allie et al. | 381/71 |
| 4,815,139 | 3/1989 | Eriksson et al. | 381/71 |
| 4,837,834 | 6/1989 | Allie | 381/71 |

*Primary Examiner*—Brian W. Brown
*Assistant Examiner*—Khann Dang
*Attorney, Agent, or Firm*—Andrus, Sceales, Starke & Sawall

[57] ABSTRACT

An acoustic system has a chamber (12) having an input (14) for receiving an input acoustic wave and guiding the input acoustic wave along a flowpath (16) to a chamber output (18), an acoustic transducer (20, 22, 24) interacting with the acoustic wave in the chamber (12), and a venturi (30, 32, 34) drawing air into the flowpath (16) to flow to the chamber output (18). The venturi aspirates internal areas of the chamber to keep the acoustic transducers clean and/or aspirates external air into the chamber past the transducers to cool same.

31 Claims, 2 Drawing Sheets

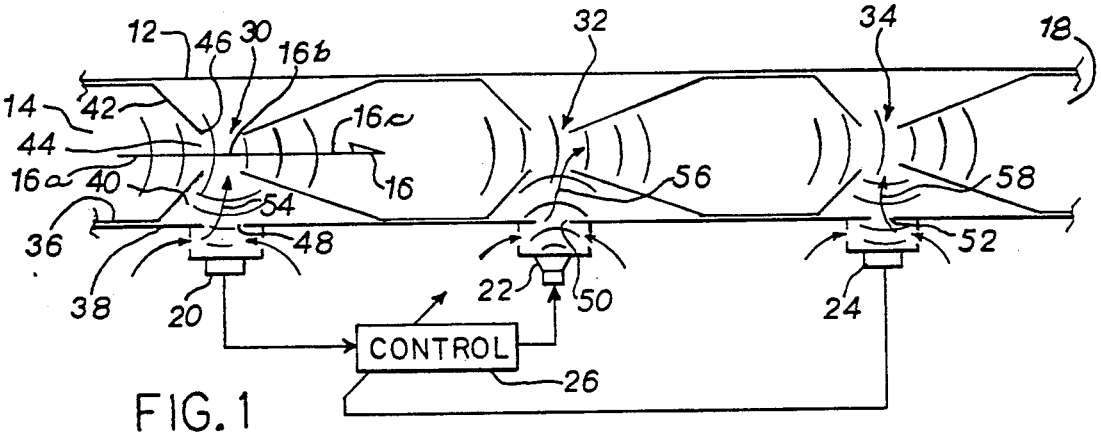
FIG. 1
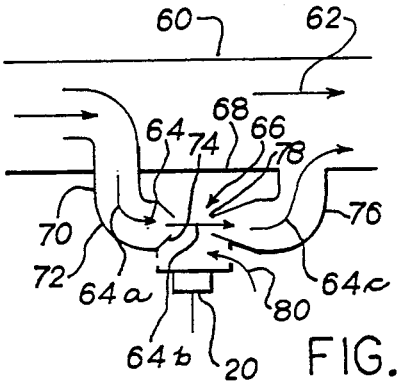
FIG. 2
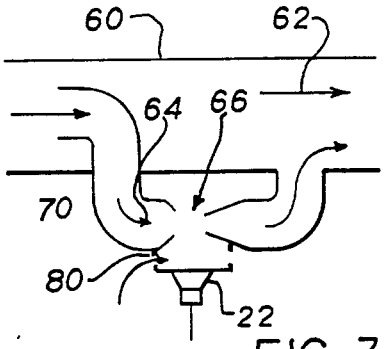
FIG. 3
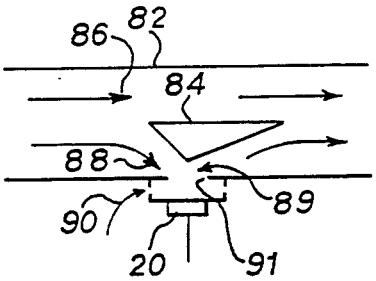
FIG. 5
FIG. 4
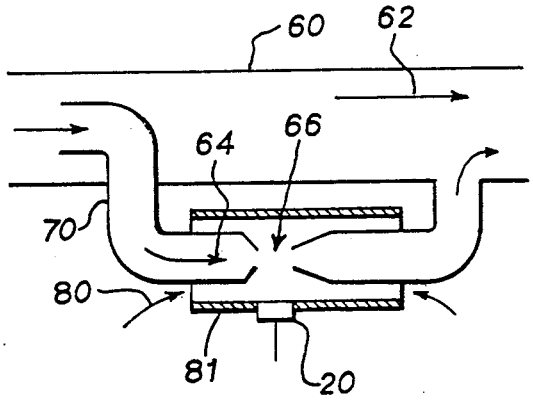
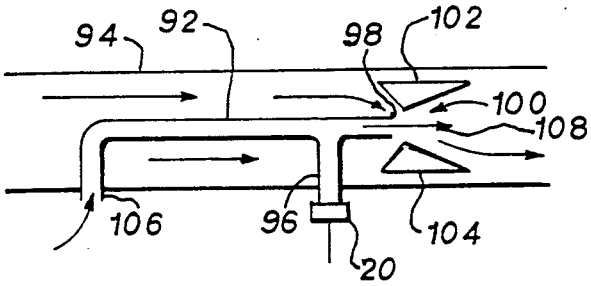
FIG. 6

ACOUSTIC SYSTEM WITH TRANSDUCER AND VENTURI

BACKGROUND AND SUMMARY

The invention relates to acoustic systems, and more particularly to an acoustic system including a chamber having an input for receiving an input acoustic wave and guiding the input acoustic wave along a flowpath to a chamber output, and an acoustic transducer interacting with the acoustic wave in the chamber.

The invention arose during continuing development efforts relating to the subject matter shown and described in U.S. Pat. Nos. 4,665,549, 4,677,676, 4,677,677, 4,736,431, 4,815,139, 4,837,834, incorporated herein by reference. The patents show various active acoustic attenuation systems. Active acoustic attenuation is accomplished by sound wave interference. Undesirable noise is attenuated by the introduction of canceling sound which ideally is a mirror image of the undesirable sound, to thus cancel same. The present invention is applicable to active attenuation and other acoustic systems.

The present invention provides a venturi for cooling and/or cleaning an acoustic transducer such as a microphone or a canceling loudspeaker. The invention provides various chamber and venturi structures in combination.

Mufflers with venturis are known in the prior art, for example U.S. Pat. Nos. 4,487,289 and 4,697,668.

BRIEF DESCRIPTION OF THE DRAWINGS

FIG. 1 is a schematic illustration of an acoustic system in accordance with the invention.

FIG. 2 shows an alternate embodiment of a portion of the system of FIG. 1.

FIG. 3 is like FIG. 2 and shows another embodiment of a portion of the system of FIG. 1.

FIG. 4 is like FIG. 2 and shows another embodiment of a portion of the system in FIG. 1.

FIG. 5 shows another embodiment of a portion of the system of FIG. 1.

FIG. 6 shows another embodiment of a portion of the system of FIG. 1.

DETAILED DESCRIPTION

Figure 7:
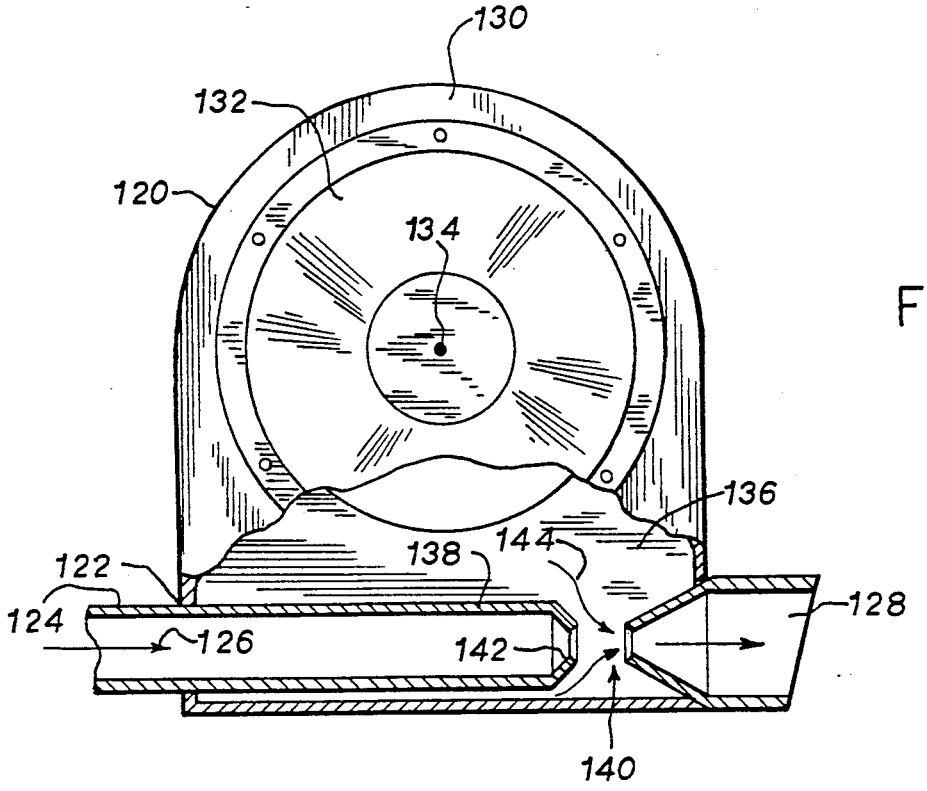
FIG. 7 shows the present invention applied to the acoustic system of copending application Ser. No. 07/468,590, filed Jan. 23, 1990, now U.S. Pat. No. 5,044,464, issued Sept. 3, 1991, incorporated herein by reference.

FIG. 1 shows an active acoustic attenuation system for cancellation of noise. The system includes a chamber or duct 12 having an input 14 for receiving an input acoustic wave and guiding the input acoustic wave along a flowpath 16 to a chamber output 18. The system includes an input acoustic transducer 20, provided by an input microphone sensing the input noise, an output transducer 22, provided by a loudspeaker injecting sound to cancel the input noise, and an error transducer 24, provided by a microphone sensing the output acoustic wave and providing an error signal to controller 26. It is preferred that controller 26 be the active acoustic attenuation adaptive filter model shown and described in incorporated U.S. Pat. Nos. 4,677,676, 4,677,677, 4,736,431, 4,815,139 and 4,837,834. It is also preferred that the hybrid active silencing techniques shown and described in incorporated U.S. Pat. No. 4,665,549 be used as appropriate. Controller 26 receives the input noise signal from input transducer 20 and models the acoustic path to output a canceling signal to output transducer 22 such that the error signal provided by error transducer 24 is zero or some given value, as is known and taught in the noted incorporated patents.

In accordance with the present invention, one or more venturis, such as 30, 32, 34, are provided in chamber 12 and draw air into flowpath 16 to flow to chamber output 18. The chamber includes a first portion provided by an inner guidewall 36 defining the flowpath, and a second portion provided by an outer wall 38 defining a space 40 adjacent guidewall 36 and defining a communication path from space 40 to flowpath 16. Transducer 20 is mounted to the chamber at space 40 and communicates with flowpath 16. The arrangements for transducers 22 and 24 are comparable. Venturi 30 is in flowpath 16 and draws air from space 40. Inner guidewall 36 includes an inwardly tapered restricted guidewall portion 42 spaced inwardly from outer wall 38 and defining a restricted passage 44 at opening 46, to form venturi 30. Transducer 20 is mounted to chamber 12 at a location external of restricted passage 44. Outer wall 38 surrounds inner guidewall 36 and tapered restricted portion 42 and defines space 40 therebetween. Opening 46 at tapered restricted portion 42 communicates with space 40. The wall structure in the chamber defines a first section **16*a* of the flowpath of given cross sectional area, a second section 16*b* of the flowpath of reduced cross sectional area relative to first section 16*a*, and a third section 16*c* of the flowpath of larger cross sectional area than second section 16*b***.

Venturi 30 draws air from internal areas of chamber 12, including space 40, to keep such internal areas clean, including keeping transducer 20 clean. Transducers 22 and 24 are cleaned in like manner by respective venturis 32 and 34. Additionally, the chamber may have one or more aspiration openings, such as 48, 50, 52, adjacent respective transducers 20, 22, 24, through which cooling air, shown at respective air flow arrows 54, 56, 58, is aspirated and drawn into the chamber past the respective transducer to cool same, and into the flowpath to flow to chamber output 18, to also cool the chamber, particularly when chamber input 14 is receiving hot exhaust gas.

FIG. 2 shows an alternate embodiment. Chamber 60 has a main flowpath section defining a main flowpath 62, and an auxiliary flowpath section tapped off of the main flowpath section and defining an auxiliary flowpath 64 in parallel with main flowpath 62. Venturi 66 is in the auxiliary flowpath section. Transducer 20 is mounted to the chamber at the auxiliary flowpath section. The chamber includes a main guidewall 68 defining the main flowpath section, and an auxiliary guidewall 70 extending externally of main guidewall 68 and defining the auxiliary flowpath section. Main guidewall 68 defines the main flowpath 62 of given cross sectional area. Auxiliary guidewall 70 has a first portion 72 extending from the main flowpath section externally of main guidewall 68 and defining a first portion **64*a* of the auxiliary flowpath of reduced cross sectional area relative to main flowpath 62, and a second portion 74 defining a second portion 64*b* of the auxiliary flowpath of reduced cross sectional area relative to first portion 64*a*, and a third portion 76 defining a third portion 64*c* of the auxiliary flowpath of larger cross sectional area than second portion 64b. Venturi 66 is provided by second portion 74 of auxiliary guidewall 70. Portion 74 of auxiliary guidewall 70 has an opening 78 therein. Transducer 20 is mounted to the chamber adjacent opening 78. Transducer 20 may be the input microphone as shown, or may be the error microphone 24, or may be the canceling loudspeaker 22 as shown in FIG. 3. External cooling air is aspirated as shown at air flow arrow 80. In FIG. 4, a passive silencer or muffler 81 is provided around auxiliary guidewall 70**.

In FIG. 5, chamber 82 has an internal wedge shaped splitter section 84 splitting the flowpath into a main flowpath 86 and a restricted flowpath 88 of reduced cross sectional area relative to main flowpath 86. The restricted flowpath section forms venturi 89 at the bottom of wedge shaped splitter section 84. Transducer 20 is mounted to the chamber at the restricted flowpath section. External cooling air shown at air flow arrow 90 is aspirated thorugh opening 91.

In FIG. 6, a probe tube 92 is provided in chamber 94. The probe tube has an input end 96 extending externally of the chamber and adjacent transducer 20. Probe tube 92 has an output end 98 within chamber 94 and adjacent venturi 100 formed between a pair of wedge shaped facing splitter sections 102 and 104. Probe tube 92 has a second input end 106 communicating externally of chamber 94 and aspirating external air through the probe tube to the flowpath 108.

FIG. 7 shows the present invention applied to the active acoustic attenuation mixing chamber of above noted and incorporated copending application Ser. No. 07/468,590, filed Jan. 23, 1990, now U.S. Pat. No. 5,044,464, issued Sept. 3, 1991. The system includes a mixing chamber 120 having an input 122 receiving exhaust from an exhaust pipe 124, such as an automobile exhaust pipe, and directing the exhaust along a flowpath 126 to a chamber output 128. The chamber has an acoustic source mounting section 130 mounting an acoustic source 132, provided by a canceling loudspeaker, directed along an axial centerline 134 perpendicular to and offset from flowpath 126. Acoustic source 132 introduces sound into chamber 120 at space 136 having a transverse area in the plane of the page at least as large as acoustic source 132, to minimize acoustic loading of acoustic source 132. The sound from acoustic source 132 cancels undesirable noise in exhaust pipe 124.

Tube 138, which may be exhaust pipe 124 or a separate pipe, extends from chamber input 122 within the chamber below axial centerline 134 of acoustic source 132 and stops short of the chamber output. Acoustic source 132 is mounted to the chamber at an opening in a sidewall of the chamber, which opening has a diameter substantially larger than the diameter of tube 138. Acoustic source 132 extends externally from the chamber. The exhaust flows along flowpath 126 through tube 138. Venturi 140 is at the output end of tube 138 at inwardly tapered wall segments 142. Venturi 140 aspirates air from chamber 120, as shown at air flow arrow 144, to keep space 136 clean, including acoustic source 132.

Figure 8:
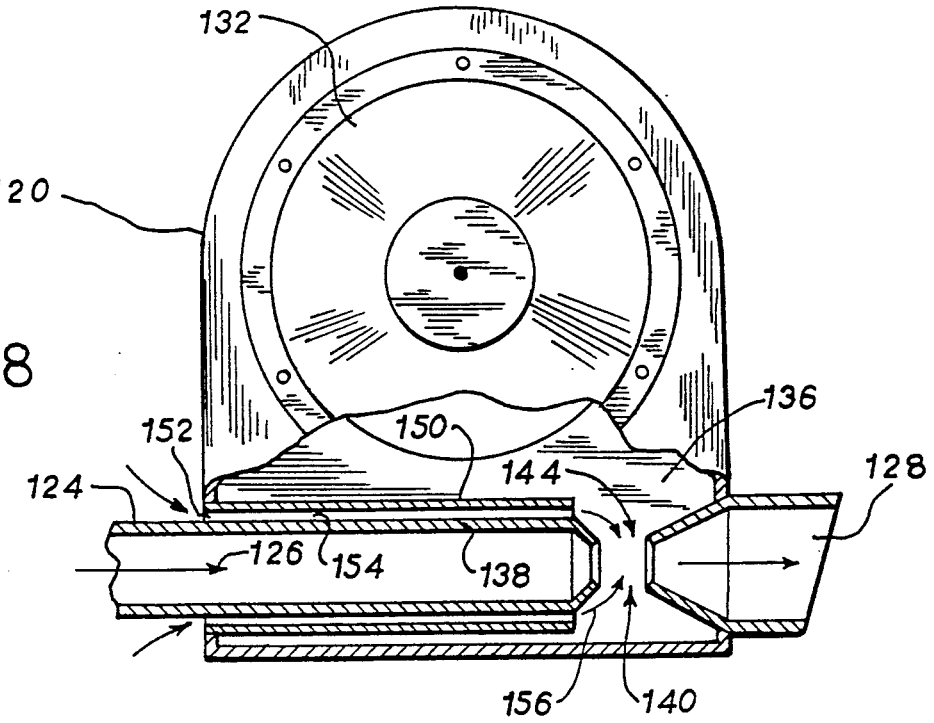
FIG. 8 is like FIG. 7 and shows a further embodiment.

FIG. 8 shows a further embodiment of FIG. 7 and uses like reference numerals where appropriate to facilitate understanding. Another tube 150 is provided in chamber 120 concentric to tube 138 and extending from the chamber input and having an external air inlet 152 at the chamber input for receiving external air into the annular space 154 between inner tube 138 and outer tube 150, which air is aspirated by venturi 140, as shown at air flow arrow 156, to be drawn into the flowpath 126 to flow to chamber output 128.

It is recognized that various equivalents, alternatives and modifications are possible within the scope of the appended claims. For example, though the preferred embodiment is used in combination with an active acoustic attenuation system, the invention may be used with other acoustic systems having an acoustic transducer interacting with the acoustic wave in the chamber.

I claim:

1. An acoustic system comprising a chamber having an input for receiving an input acoustic wave and guiding said input acoustic wave along a flowpath to a chamber output, an acoustic transducer interacting with said acoustic wave in said chamber, a venturi in said chamber drawing air into said flowpath to flow to said chamber output, wherein at least a portion of said flowpath flows through said venturi, and wherein said venturi directs said flowpath away from said transducer and also prevents backflow from said flowpath to said transducer to prevent air in said flowpath from traveling to said transducer.

2. The invention according to claim 1 wherein said chamber includes a first portion defining said flowpath, and a second portion defining a space adjacent said first portion and defining a communication path from said space to said flowpath, and wherein said transducer is mounted to said chamber at said space and communicates with said flowpath.

3. The invention according to claim 2 wherein said venturi is in said flowpath and draws air from said space.

4. The invention according to claim 3 wherein said first portion of said chamber comprises a guidewall defining a restricted passage in said chamber forming said venturi, and wherein said second portion of said chamber surrounds said first portion and defines said space therebetween.

5. The invention according to claim 1 wherein said chamber has a first section defining a first section of said flowpath of given cross sectional area, a second section defining a second section of said flowpath of reduced cross sectional area relative to said first section, and a third section defining a third section of said flowpath of larger cross sectional area than said second section.

6. The invention according to claim 1 wherein said chamber has an inner wall and an outer wall, said inner wall having a restricted portion spaced inwardly from said outer wall and forming said venturi, said inner wall having an opening therein at said restricted portion communicating with the space between said inner wall and said outer wall.

7. The invention according to claim 1 wherein said chamber has a main flowpath section defining a main flowpath, and an auxiliary flowpath section tapped off of said main flowpath section and defining an auxiliary flowpath in parallel with said main flowpath, and wherein said venturi is in said auxiliary flowpath section.

8. The invention according to claim 7 wherein said transducer is mounted to said chamber at said auxiliary flowpath section.

9. The invention according to claim 8 wherein said chamber includes a main guidewall defining said main flowpath section, and an auxiliary guidewall extending externally of said main guidewall and defining said auxiliary flowpath section.

10. The invention according to claim 9 wherein:

said main guidewall defines said main flowpath of given cross sectional area;

said auxiliary guidewall comprises:

a first portion extending from said main flowpath section externally of said main guidewall and defining a first portion of said auxiliary flowpath of reduced cross sectional area relative to said main flowpath;

a second portion defining a second portion of said auxiliary flowpath of reduced cross sectional area relative to said first portion of said auxiliary flowpath;

a third portion defining a third portion of said auxiliary flowpath of larger cross sectional area than said second portion of said auxiliary flowpath.

11. The invention according to claim 10 wherein said venturi is provided by said second portion of said auxiliary guidewall.

12. The invention according to claim 11 wherein said second portion of said auxiliary guidewall has an opening therein, and wherein said transducer is mounted to said chamber adjacent said opening.

13. The invention according to claim 12 comprising a passive silencer around said auxiliary guidewall.

14. The invention according to claim 1 wherein said chamber has an internal splitter section splitting said flowpath into a main flowpath section and a restricted flowpath section of reduced cross sectional area relative to said main flowpath section, said restricted flowpath section forming said venturi.

15. The invention according to claim 14 wherein said transducer is mounted to said chamber at said restricted flowpath section.

16. The invention according to claim 1 comprising a probe tube in said chamber, said probe tube having an input end extending externally of said chamber and adjacent said transducer, said probe tube having an output end within said chamber and adjacent said venturi.

17. The invention according to claim 1 wherein said transducer comprises an acoustic source mounted to said chamber and directed along an axial centerline perpendicular to and offset from said flowpath, said acoustic source introducing sound into said chamber at a space having a transverse area at least as large as said acoustic source, to minimize acoustic loading of said acoustic source.

18. The invention according to claim 17 comprising a tube within said chamber and extending from said chamber input below said axial centerline and stopping short of said chamber output, said flowpath extending through said tube, said venturi being at the output of said tube.

19. The invention according to claim 18 wherein said acoustic source is mounted to said chamber at an opening in a sidewall of said chamber, said acoustic source extending externally from said chamber, said opening in said sidewall having a diameter substantially larger than the diameter of said tube.

20. An acoustic system comprising a chamber having an input for receiving an input acoustic wave and guiding said input acoustic wave along a flowpath to a chamber output, an acoustic transducer interacting with said acoustic wave in said chamber, a venturi comprising a guidewall in said chamber defining a restricted passage in said chamber drawing air from internal areas of said chamber into said flowpath to keep said internal areas clean, wherein at least a portion of said flowpath flows through said venturi, and wherein said venturi directs said flowpath away from said transducer and also prevents backflow from said flowpath to said transducer to prevent air in said flowpath from traveling to said transducer.

21. The invention according to claim 20 wherein said transducer is mounted to said chamber at a location external of said restricted passage.

22. The invention according to claim 21 wherein said chamber has an outer wall, and wherein said guidewall comprises an inner wall spaced inwardly of said outer wall and defining said restricted passage therethrough and reducing the cross sectional area of said flowpath, and wherein said inner wall and said outer wall have a space therebetween, and wherein said inner wall has an opening therethrough communicating with said space such that air is drawn from said space into said flowpath through said opening to keep said space clean.

23. An acoustic system comprising a chamber having an input for receiving an input acoustic wave and guiding said input acoustic wave along a flowpath to a chamber output, an acoustic transducer interacting with said acoustic wave in said chamber, an aspiration opening in said chamber, a venturi in said chamber aspirating external air through said aspiration opening into said flowpath in said chamber to cool same, wherein at least a portion of said flowpath flows through said venturi, and wherein said venturi directs said flowpath away from said transducer and also prevents backflow from said flowpath to said transducer to prevent air in said flowpath from traveling to said transducer.

24. The invention according to claim 23 wherein said aspiration opening is adjacent said transducer and said external air is aspirated past said transducer to cool said transducer.

25. The invention according to claim 23 wherein said aspiration opening is adjacent said chamber input, and comprising a guidewall defining an air passage from said aspiration opening to said venturi, such that external air is aspirated through said aspiration opening and flows through said air passage and said venturi to said flowpath.

26. The invention according to claim 25 comprising an inner tube within said chamber extending from said chamber input and stopping short of said chamber output, said venturi being provided at the output end of said inner tube, and wherein said guidewall comprises an outer tube concentric to said inner tube and extending from said chamber input and having an air inlet at said chamber input for receiving air into the space between said inner and outer tubes.

27. The invention according to claim 23 comprising a probe tube in said chamber, said probe tube having an input end extending externally of said chamber and adjacent said transducer, said probe tube having an output end within said chamber and adjacent said venturi, said probe tube having a second input end communicating externally of said chamber and aspirating external air through said probe tube to said flowpath.

28. Active acoustic attenuation apparatus comprising a chamber having an input for receiving an input acoustic wave and guiding said input acoustic wave along a flowpath therethrough to a chamber output, a plurality of acoustic transducers including an output transducer introducing a canceling acoustic wave into said chamber, and an error transducer sensing the acoustic wave output by said chamber output, at least one venturi in said chamber drawing air into said flowpath to flow out said chamber output, wherein at least a portion of said flowpath flows through said venturi, and wherein said venturi directs said flowpath away from said transducer and also prevents backflow from said flowpath to said transducer to prevent air in said flowpath from traveling to said transducer.

29. The invention according to claim 28 wherein said venturi draws external air into said chamber past at least one of said transducers and into said flowpath to flow to said chamber output, such that said one transducer is cooled by the flow of said external air therepast.

30. The invention according to claim 29 wherein said chamber has an outer wall, and said venturi comprises a guidewall in said chamber having an internal wall portion spaced inwardly of said outer wall and defining a restricted passage therethrough and reducing the cross sectional area of said flowpath, and wherein said internal wall portion and said outer wall have a space therebetween, and wherein said venturi draws air from said space to keep the latter clean.

31. The invention according to claim 30 wherein said one transducer is mounted to said chamber at said space, and wherein said outer wall has an opening therethrough adjacent said transducer and through which external air is aspirated.

* * * * *